US009057505B2

(12) United States Patent
Liu et al.

(10) Patent No.: US 9,057,505 B2
(45) Date of Patent: Jun. 16, 2015

(54) LAMP WITH REPLACEABLE DECORATIVE COVER

(71) Applicant: Shenzhen Jiawei Photovoltaic Lighting Co., Ltd., Shenzhen (CN)

(72) Inventors: Zhiyong Liu, Shenzhen (CN); Ping Yan, Shenzhen (CN)

(73) Assignee: SHENZHEN JIA WEI PHOTOVOLTAIC LIGHTING CO., LTD, Shenzhen (CN)

( * ) Notice: Subject to any disclaimer, the term of this patent is extended or adjusted under 35 U.S.C. 154(b) by 0 days.

(21) Appl. No.: 14/038,213

(22) Filed: Sep. 26, 2013

(65) Prior Publication Data

US 2015/0043210 A1 Feb. 12, 2015

(30) Foreign Application Priority Data

Aug. 8, 2013 (CN) ..... 2013 2 0484002 U

(51) Int. Cl.
*F21V 29/00* (2006.01)
*F21K 99/00* (2010.01)

(52) U.S. Cl.
CPC ..... *F21V 29/004* (2013.01); *F21K 9/50* (2013.01)

(58) Field of Classification Search
USPC ..... 362/147, 148, 150, 312, 313, 396, 433, 362/457, 458, 806
See application file for complete search history.

(56) References Cited

U.S. PATENT DOCUMENTS

| | | | | |
|---|---|---|---|---|
| 5,673,997 | A * | 10/1997 | Akiyama | 362/147 |
| 5,957,572 | A * | 9/1999 | Wedekind et al. | 362/365 |
| 6,421,904 | B1 * | 7/2002 | Wedekind et al. | 29/432 |
| 6,588,922 | B1 * | 7/2003 | DeCicco | 362/364 |
| 6,719,438 | B2 * | 4/2004 | Sevack et al. | 362/147 |
| 6,830,362 | B2 * | 12/2004 | Mullen | 362/455 |
| 6,957,896 | B2 * | 10/2005 | Burgess | 362/147 |
| 7,198,391 | B2 * | 4/2007 | Rutchik | 362/365 |
| 7,500,766 | B1 * | 3/2009 | Reynolds | 362/364 |
| 2011/0096554 | A1 * | 4/2011 | Jowid | 362/351 |

* cited by examiner

*Primary Examiner* — Laura Tso
(74) *Attorney, Agent, or Firm* — Hamre, Schumann, Mueller & Larson, P.C.

(57) ABSTRACT

The present invention relates to a lamp structure field, and discloses a lamp with a replaceable decorative cover, comprising a radiator having an opening in an end thereof; an LED source and a reflector disposed in a cavity of the radiator; and a decorative cover covering the opening of the radiator, wherein the radiator is provided with a plurality of elastic sheets, the decorative cover is clamped and fixed to the radiator through the elastic sheets in a detachable manner. The lamp with replaceable decorative cover of the present invention, whose decorative cover is disposed on a bottom of the lamp through the special design elastic sheet in a detachable manner and may be replaced at any time according to different requirements of the user, satisfies the various requirements of the user, in addition, the simple structure, stable connection, simple assembly and convenient disassemble further improve the practicality of the product.

8 Claims, 3 Drawing Sheets

LAMP WITH REPLACEABLE DECORATIVE COVER

TECHNICAL FIELD

The present invention relates to a lamp structure field, and more particularly, to a lamp with replaceable decorative cover.

BACKGROUND

Nowadays, in the market, for a lamp with simple design, a lamp body and a decorative cover are usually fixed and assembled in a manner similar to the magnet fixing. However the magnet has some affect to the relevant internal components of the lamp and the cost of magnet is relatively high. In addition, it is inconvenient for the assembly and disassembly of the lamp body and the decorative cover and the fixing effect is ordinary. With the increase of user requirement, the user requirements for the shape and color of the decorative cover are different, therefore it is needed to replace the whole lamp body to achieve the purpose of replacing the decoration, which is not worthwhile and convenient.

How to design a lamp whose decorative cover may be replace directly without replacing the lamp body and with simple structure, safe and stable connection and convenient for disassembly, is the technical problem that needs to be solved in this field.

SUMMARY

The present invention aims at providing a lamp with replaceable decorative cover and solving the problem that in the prior art it is need to replace the lamp body to replace the decorative cover and the connection is instable.

The present invention is achieved as follow, a lamp with a replaceable decorative cover, comprising a radiator having an opening in an end thereof; an LED source and a reflector disposed in a cavity of the radiator; and a decorative cover covering and matched with the opening of the radiator, wherein, the radiator is provided with a plurality of elastic sheets, the decorative cover is clamped and fixed to the radiator through the elastic sheet in a detachable manner.

Further, the radiator is a cap shaped structure, an inner surface of a cap top is provided with an immersed groove, the LED source and the reflector are fixed in the immersed groove, and the periphery of the immersed groove is provided with a slot matched with the respective elastic sheet.

Further, the slot comprises a main groove, a side of the main groove extends and forms a wedge shaped sub-groove, and the elastic sheet is inserted in the main groove.

Further, the elastic sheet comprises an inserting end and a connecting end, the inserting end is bended to form an acute angle, and the connecting end is bended to form a step.

Further, the inserting end is inserted in and presses against the main groove of the slot, and the connecting end is matched and connected in a clamp mode with the decorative cover.

Further, the decorative cover comprises a decorative plate, the decorative plate is provided with a flange vertically extending from a surface of the decorative plate and matched with the radiator.

Further, the top edge of the flange is everted.

Further, the flange is inserted into the cavity of the radiator, the top edge of the flange is matched and connected in a clamp mode with the step of the connecting end of the elastic sheet.

Further, the decorative plate and the flange are integrally formed.

Compared with the prior art, The lamp with replaceable decorative cover of the present invention, whose decorative cover is disposed on the bottom of the lamp through the special design elastic sheet in a detachable manner and may be replaced at any time according to different requirements of the user, satisfies the various requirements of the user, in addition, the simple structure, stable connection, simple assembly and convenient disassembly further improve the practicality of the product.

DETAILED DESCRIPTION OF THE PREFERRED EMBODIMENTS

To make the objectives, technical solutions and advantages of the present invention clearer, the present invention will be further described hereafter with reference to the accompany drawings and embodiments. However, it shall be understood that, the embodiments described herein are only intended to illustrate but not to limit the present invention.

The invention is described in detail below in conjunction with the specific drawings.

Figure 1:
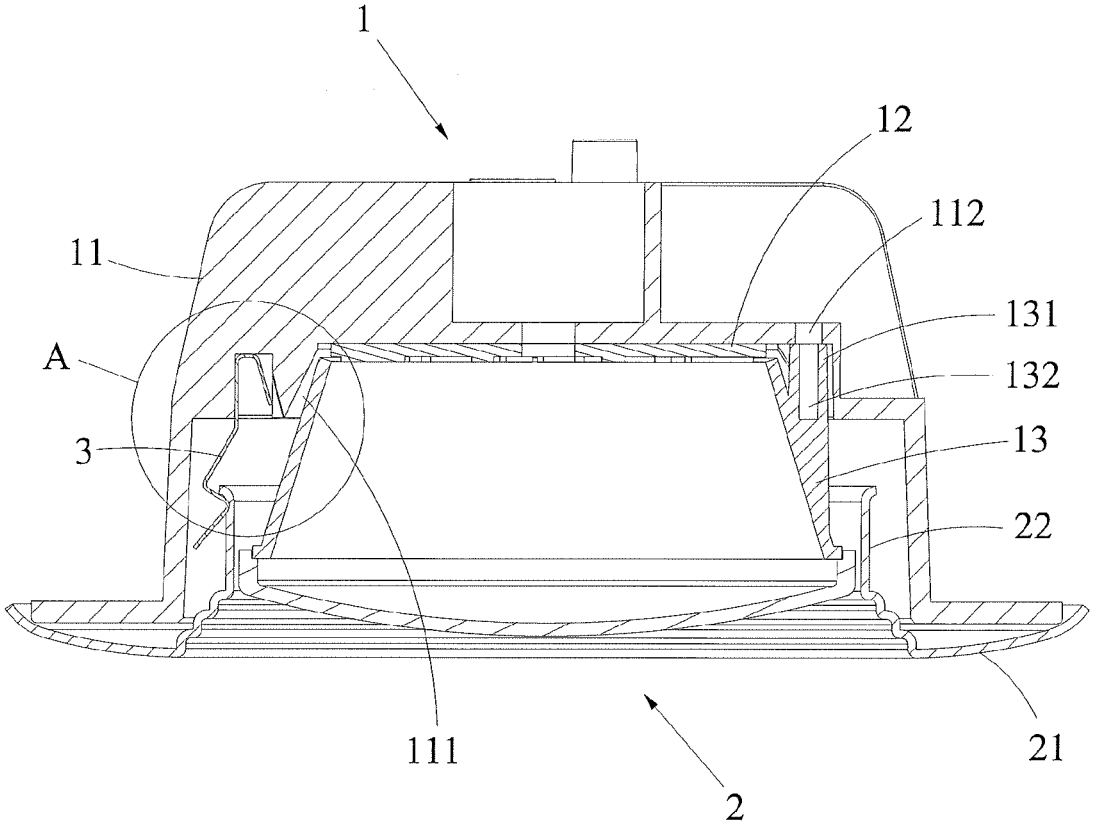
FIG. 1 is a schematic sectional view of a lamp with a replaceable decorative cover of an embodiment of the present invention.
Figure 2:
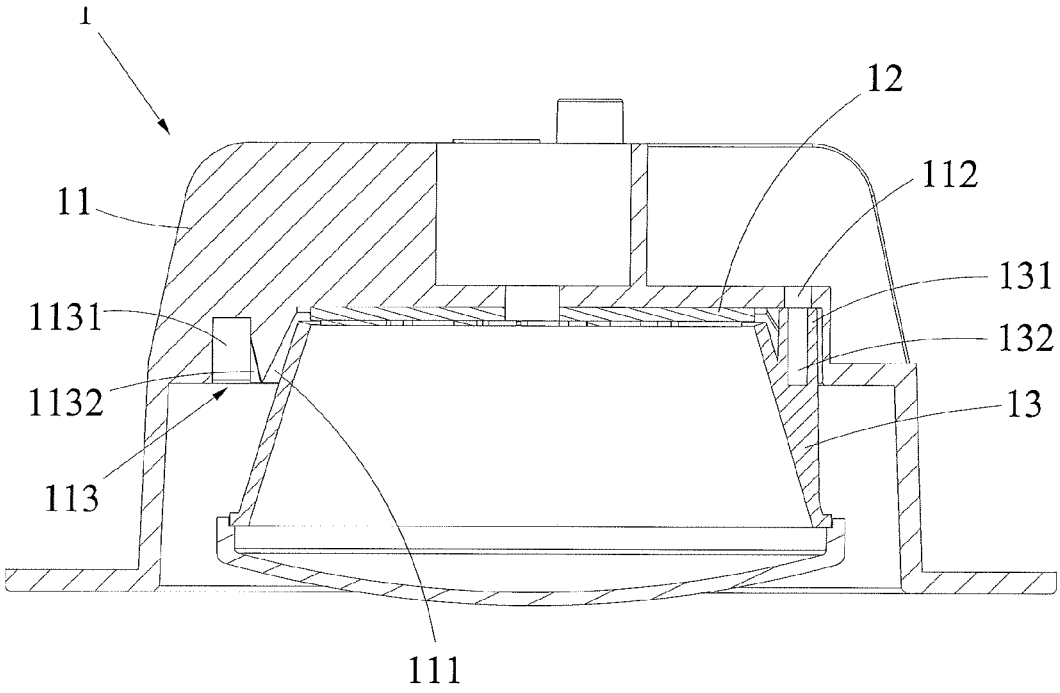
FIG. 2 is a schematic sectional view of the lamp body of lamp with a replaceable decorative cover of the embodiment of the present invention.
Figure 3:
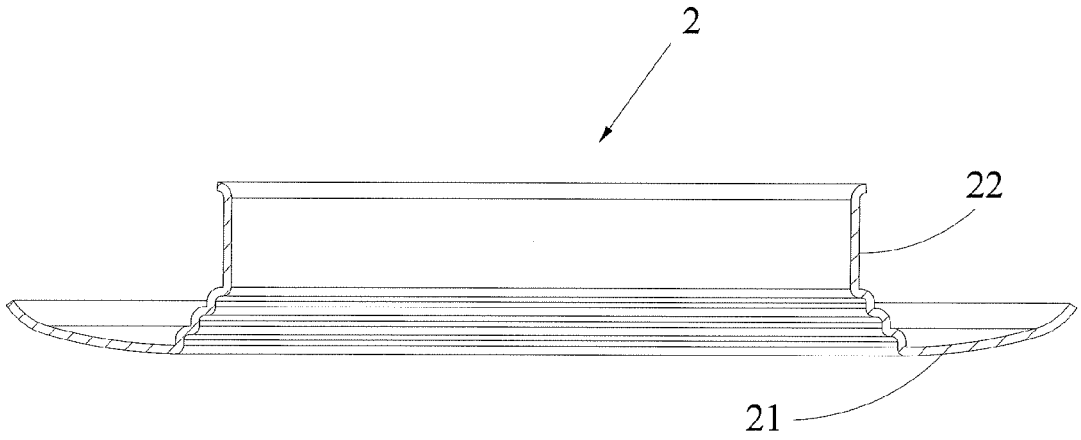
FIG. 3 is a schematic sectional view of the decorative cover of the lamp with a replaceable decorative cover of the embodiment of the present invention.
Figure 4:
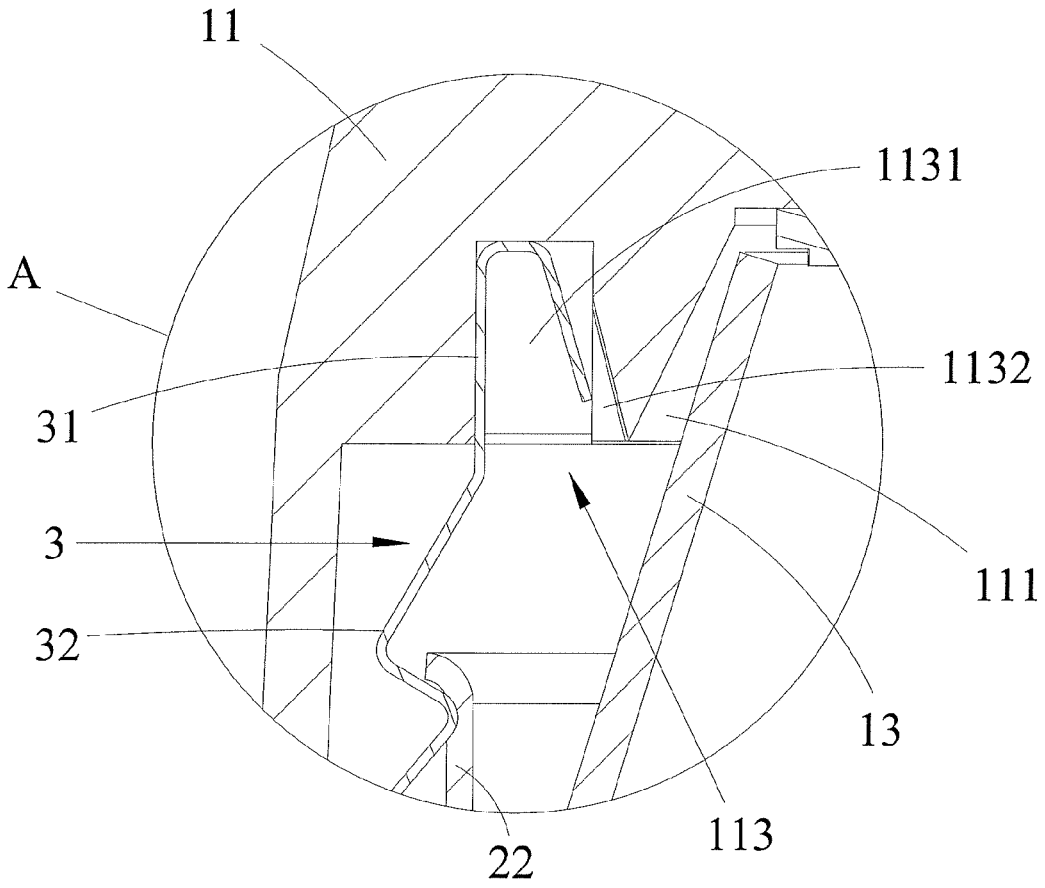
FIG. 4 is a schematic enlarged view of the A part in FIG. 1.

As shown in FIG. 1 to FIG. 4, an embodiment of the present invention is provided.

For the ordinary lamp in the market, the lamp body and the decorative cover are usually fixed and assembled in a manner similar to the magnet fixing and it is need to replace the whole body to replace the decorative cover. For the lamp with replaceable decorative cover of the present invention, the lamp body and the decorative cover are assembled and fixed in a detachable manner by using the elastic sheet through the modular design for the lamp body and the decorative cover, and the lamp is provided with a simple structure, stable connection, simple and convenient assembly and disassembly, and also satisfies the requirement of the user for variety of the decorative cover.

In this embodiment, the lamp with a replaceable decorative cover comprises a lamp body 1 and a decorative cover 2 disposed up and down. The lamp body comprises a radiator 11, an LED source 12 and a reflector 13 which are assembled in an embedded mode. An end of the radiator 11 is provided with an opening. The LED source is fixed on an inner surface of a closed end of the radiator 11, and the reflector 13 is fixedly connected with the bottom of the LED source 12. A plurality of evenly distributed elastic sheets 3 extend from the periphery of the closed end of the radiator 11. An extending end of the elastic sheet 3 is between the inner wall of the radiator 11 and the outer wall of the reflector 13. The decorative cover 2 is matched with the opening of the radiator 11, an upper end of the decorative cover 2 is inserted in the cavity of the radiator 11, and the upper end of the decorative cover 2 is matched with each elastic sheet 3 and is fixed, therefore the lamp body 1 is combined with the decorative cover 3 and forms a whole.

The above lamp with replaceable decorative cover has the follow features:

1) using the integration design, that is, the lamp body 2 and the decorative cover 2 are designed respectively, due to the design, the lamp body 1 may be matched with the decorative cover with different shape and different color, under the situation that the user use the same lamp body, many different decorative covers may be used, which satisfy the requirement of the user for variety and also save the cost;

2) using the elastic sheet clamp connection design, through the elastic sheet 3 the decorative cover 2 is connected in the clamp mode with the lamp body 1 to be fixed, the design is with simple structure, is assembled quickly and conveniently and is disassembled conveniently for replacement;

3) ensuring the reliable fixed connection between the decorative cover 2 and the lamp body 1, using the principles of mechanics, it can deduce that the strength of the elastic sheet 3 is proportional to the weight of the decorative cover 2, and the elastic sheet 3 with required harness is correspondingly produced, thus the reliable fixed connection between the decorative cover 2 and the lamp body 1 may be ensured.

In this embodiment, the radiator 11 is a cap shaped structure. An inner surface of a cap top of the radiator 11 is provided with an immersed groove 111 for installing the LED source 12 and reflector 13. The LED source 12 is pasted on the bottom of the immersed groove 111, and the upper end of the reflector 13 are fixed in the immersed groove 111 and are disposed below the LED source. According to specific situation, the LED resource may be fixed in the immersed groove 111 in other manner, for example, the LED source 12 may be fixed in the immersed groove 111 by using a screw.

The reflector 13 is a cup shaped structure with a narrow top and a wide bottom. The periphery of the outer wall of the upper end of the reflector 13 is integrally provided with three evenly distributed connecting piles 131, each pile 131 is provided with a screw hole 132. Accordingly, the cap top of the radiator 11 is provided with an installing hole 112 corresponding to the respective screw hole 132. When assembled, the installing hole 112 is aligned with the screw hole 132, then a screw passes through the installing hole 112 and is matched with the screw hole 132 to be fixed. Therefore, the fixed connection for the reflector 13 and the radiator 11 is achieved. According to specific situation, in other embodiment, the reflector 13 and the radiator 11 may be fixedly connected in other manner.

Three evenly distributed slots 113 are disposed on an inner surface of the cap top of the radiator 11 and around the immersed groove 111. The slot is configured to clamp the elastic sheet 3. The upper end of the respective elastic sheet is inserted into the corresponding slot 113 and presses against the inner surface of the slot to be fixed, and the lower end of the respective elastic sheet extends into the gap formed by the outer wall of the reflector 13 and the inner wall of the radiator 11. According to specific situation and actual requirement, more elastic sheet may be disposed to ensure a more stable connection between the decorative cover 2 and the radiator 11.

Specifically, the slot 113 comprises a square main groove 1131, a side of the main groove extends and forms a wedge shaped sub-groove 1132, the width of the sub-groove is smaller than the width of the main groove. The elastic sheet 3 is inserted in the main groove 1131 of the slot 113 and presses against the wall of the main groove. When the elastic sheet is disassembled, the sub-groove is configured to facilitate the external tool to pry the elastic sheet. In other embodiment, the slot 113 may be provided with other structure.

The elastic sheet 3 comprises an inserting end 31 and a connecting end 32. The inserting end 31 is bended to form an acute angle and is inserted into the main groove 1131 of the slot 113, and the end portion of the inserting end 31 presses against the wall of the main groove 1131 to be clamped. The connecting end 32 extends downward from the end of the inserting end 31 and is bended to form a step relative to the inserting end 32. The connecting end is matched with the decorative cover 2 through the step for fixing. According to specific situation and actual requirement, the elastic sheet may be with other structure whose purpose is connecting the lamp body 1 and the decorative cover 2 from up to down.

The decorative cover 2 comprises a decorative plate 21 and a flange 22. The flange 22 vertically extends from a surface of the decorative plate 21 and the top edge of the flange 22 is everted for being matched with the step of the connecting end 32 of the elastic sheet 3. In this embodiment, the decorative plate 21 and the flange 22 are integrally formed, which facilitates manufacturing the mold for the decorative cover 2 to mass-produce the decorative cover 2, therefore more types may be provided to be selected and used by the user. This is just one of the manufacturing methods. The decorative cover 2 may be manufactured through other manufacturing process according to actual situation.

In this embodiment, when the lamp is assembled, the lamp body 1 is firstly assembled, then the inserting end 31 of the elastic sheet 3 is inserted into the slot 113 of the lamp body 1, then the flange 22 of the decorative cover 2 is inserted into the cavity of the radiator 11, it should ensure that the lower end of the reflector 13 is disposed in the flange 22, and the enverted top edge of the flange 22 is matched with the step of the connecting end 32 of the elastic sheet 3 to from the clamp connection, meanwhile the bottom edge of the radiator 11 presses against the decorative plate 21 of the decorative cover 1, therefore the lamp body 1 and the decorative cover 2 is assembled into a whole. When disassembling, it is just need to pull out the decorative cover 2.

What described above are only preferred embodiments of the present invention but are not intended to limit the scope of the present invention. Any modifications, equivalent replacements and improvements made within the sprite and principle of the present invention shall also be covered in the protection scope of the present invention.

What is claimed is:

1. A lamp with a replaceable decorative cover, comprising:

a radiator having an opening in an end thereof;

an LED source and a reflector disposed in a cavity of the radiator; and a decorative cover covering and matched with the opening of the radiator, wherein the radiator is provided with a plurality of spring members, the decorative cover is clamped and fixed to the radiator through the spring members in a detachable manner, wherein the radiator has a cap shaped structure, an inner surface of the cap shaped structure is provided with a recessed groove, the LED source and the reflector are fixed in the recessed groove, and a periphery of the recessed groove is provided with a slot matched with the respective spring member.

2. The lamp with the replaceable decorative cover of claim 1, wherein the slot comprises a main groove, a side of the main groove extends and forms a wedge shaped sub-groove, and each of the spring members is inserted in the main groove.

3. The lamp with the replaceable decorative cover of claim 2, wherein each of the spring members comprises an inserting end and a connecting end, the inserting end is bended to form an acute angle, and the connecting end is bended to form a step.

4. The lamp with the replaceable decorative cover of claim 3, wherein the inserting end is inserted in and presses against the main groove of the slot, and the connecting end is matched and connected in a clamp mode with the decorative cover.

5. The lamp with the replaceable decorative cover of claim 1, wherein the decorative cover comprises a decorative plate, the decorative plate is provided with a flange vertically extending from a surface of the decorative plate and matched with the radiator.

6. The lamp with the replaceable decorative cover of claim 5, wherein a top edge of the flange is bent down.

7. The lamp with the replaceable decorative cover of claim 6, wherein the flange is inserted into the cavity of the radiator, the top edge of the flange is matched and connected in a clamp mode with a step of the connecting end of the spring member.

8. The lamp with the replaceable decorative cover of claim 5, wherein the decorative plate and the flange are integrally formed.

* * * * *